US005506371A

United States Patent [19]

Gillaspy

[11] Patent Number: 5,506,371

[45] Date of Patent: Apr. 9, 1996

[54] SIMULATIVE AUDIO REMIXING HOME UNIT

[76] Inventor: Mark D. Gillaspy, P.O. Box 81137, Bakersfield, Calif. 93380-0201

[21] Appl. No.: 329,304

[22] Filed: Oct. 26, 1994

[51] Int. Cl.[6] ..... G10H 1/12; G10H 1/46

[52] U.S. Cl. ..... 84/699; 84/711; 84/718; 84/DIG. 9

[58] Field of Search ..... 84/622–625, 633, 84/661, 665, 699, 700, 711, 736, 741, 644, 670, 718–721, 743–746, DIG. 9

[56] References Cited

U.S. PATENT DOCUMENTS 4,957,031 9/1990 Kondo et al. .
5,148,484 9/1992 Kane et al. .
5,210,366 5/1993 Sykes, Jr. .
5,248,845 9/1993 Massie et al. .
5,298,674 3/1994 Yun .
5,323,467 6/1994 Hermes .

*Primary Examiner*—Stanley J. Witkowski
*Attorney, Agent, or Firm*—Richard C. Litman

[57] ABSTRACT

The present invention pertains to audio equipment simulative of musical instruments. The invention allows a user to simulate the playing of music reproduced from an external audio source. The present invention allows a user to quickly modify the amplification of a given audio band pass frequency by selecting a first trigger associated with that band pass frequency, and subsequently activating a second trigger to modify the selected band pass frequency. The present invention has an decorative and functional appearance which may simulate any musical instrument, such as a guitar.

14 Claims, 2 Drawing Sheets

SIMULATIVE AUDIO REMIXING HOME UNIT

BACKGROUND OF THE INVENTION

1. Field of the Invention

The present invention relates to audio equipment for modifying the frequency characteristics of an audio signal generated by an external audio source. More specifically, the present invention pertains to audio equipment simulative of musical instruments, which allows a user to simulate the playing of music reproduced from an external audio source. The present invention allows a user to quickly modify the amplification of a given audio band pass frequency by selecting a first trigger associated with that band pass frequency, and subsequently activating a second trigger to amplify or attenuate the selected band pass frequency. The present invention may be shaped and configured to resemble any musical instrument, such as a guitar.

2. Description of the Prior Art

For many non-musicians, the inability to actively interact with music, i.e., the inability to perform as an actual musician, is often frustrating. Non-musicians' only interaction with pre-recorded or live musical performances is that of a passive listener. It is this inability to actively "join in" with the production of music that causes frustration on the part of many non-musicians.

In many instances, the only recourse for non-musicians to become more actively involved with a musical performance is to mime the actions of the musicians themselves. For instance, many an untrained classical music aficionado has "conducted" the symphony while the stereo played their favorite piece. And countless would-be rock-and-roll guitarists have sequestered themselves far from public view, set the stereo to its maximum level, and thrashed an imaginary "air guitar" in emulation of their favorite performers.

The present invention addresses the frustration of non-musicians by providing an apparatus which allows a user to directly influence the presentation of any piece of recorded music. The invention requires no knowledge of music, nor the ability to play a musical instrument. In essence, the present invention allows a user to re-mix the balance of frequencies in a pre-recorded musical performance while the pre-recorded piece is being played from an external audio source.

A multitude of U.S. patents describe apparatus for storing, modifying, and reproducing electrical signals which encode audio information. For instance, U.S. Pat. No. 4,957,031, issued Sep. 18, 1990, to M. Kondo et al., describes an automatic recording and playback apparatus having plural tone generating channels separately assignable to different parts of a musical piece. In essence, this device is a conventional multitrack Fecorder. The device allows a variable number of tracks or channels to be assigned in the recording and playback of audio signals. Selected parts of the recording can be recorded or played back separate from the other parts of the recording.

U.S. Pat. No. 5,148,484, issued Sep. 15, 1992, to J. Kane et al., discloses an audio signal processing unit for separating vocal signals from non-voice signals in a combined audio signal stream.

U.S. Pat. No. 5,298,674, issued Mar. 29, 1994, to S. L. Yun, describes a device similar in function to the Kane device. This reference describes a device for discriminating between a vocal audio signals and non-vocal audio signals.

A combined vocal/instrumental signal is first pre-filtered to separate unambiguous vocal frequencies from unambiguous instrumental frequencies. An intermediate decisional logic circuit then analyzes the remaining frequencies to determine if the frequencies are attributable to vocal sources or instrumental sources.

U.S. Pat. No. 5,248,845, issued Sep. 28, 1993, to D. C. Massie et al., discloses a digital sampling instrument, i.e. a digital sampling synthesizer. The instrument allows for the synthesis of sounds imitative of acoustic instruments by recording a digital sample of the waveform of the actual instrument to be emulated. Specifically, the device addresses problems encountered when the sampled waveform of a given instrument is transposed up or down in pitch. If the waveform is transposed in pitch too far from its actual recorded pitch, undesirable waveform shifts result. These waveform shifts deteriorate the fidelity of the sound produced from the transposed waveform, resulting in an unnatural sound known as "munchkinization."

U.S. Pat. No. 5,210,366, issued May 11, 1993, to R. O. Sykes, Jr., describes a device for separating the individual voices in a musical composition preformed by a plurality of instruments. The entire combined signal frequency spectrum is compared to steady-state frequency representations for each instrument included in the performance. Frequencies which approximate the steady-state frequency representations are isolated and further comparisons are made to analyze the isolated frequencies during the growth, steady-state, and decay periods of the waveform signal. Once an acceptable match is found between an isolated waveform and a steady-state representation for a given instrument, the isolated waveform is recorded, and converted into an electrical signal which is output as musical data for a single voice of the combined signal.

U.S. Pat. No. 5,323,467, issued Jun. 21, 1994, to D. J. Hermes, discloses a device for separating an audio signal into a plurality of parallel band pass channels. In each frequency channel, the envelope of the signals found within that channel are detected, and the envelope preferentially filtered to enhance the signals at the frequency of the sound desired. The filtered channel outputs are then summed.

None of the above references, taken alone, or in any combination, is seen to describe the present invention.

SUMMARY OF THE INVENTION

The present invention relates to a musical instrument simulation device which allows a user to simulate the playing of a musical instrument. The device is preferably in the shape of a conventional musical instrument, such as a guitar.

The present invention allows a user to alter the presentation of a pre-recorded piece of music by dynamically altering the balance of audio frequencies which are output to an amplifier/speaker assembly or a recording device.

The musical instrument simulation device includes a plurality of simulated musical instrument triggers. Each trigger corresponds to a band pass signal of an external audio source signal which has been split into a plurality of unique pass band frequencies. The user identifies which band pass frequencies are to be amplified by activating the trigger associated with that band pass. Upon activating a second simulated musical instrument trigger, the selected band pass signals are amplified or attenuated by a predetermined magnitude for a predetermined period of time.

Accordingly, it is a principal object of the invention provide an apparatus which imitates a musical instrument, and allows a user thereof to actively modify the presentation of a pre-recorded musical work.

It is a further object of the invention to provide an apparatus which imitates the shape and style of play of a musical instrument, and includes triggers which allow a user to dynamically select band pass frequencies of a pre-recorded musical work, and to variably amplify or attenuate the selected band pass frequencies for a variable duration of time.

These and other objects of the present invention will become readily apparent upon further review of the following specification and drawings.

BRIEF DESCRIPTION OF THE DRAWINGS

Like reference characters are used throughout the attached drawing to denote corresponding features of the present invention.

DETAILED DESCRIPTION OF THE PREFERRED EMBODIMENT

Figure 1:
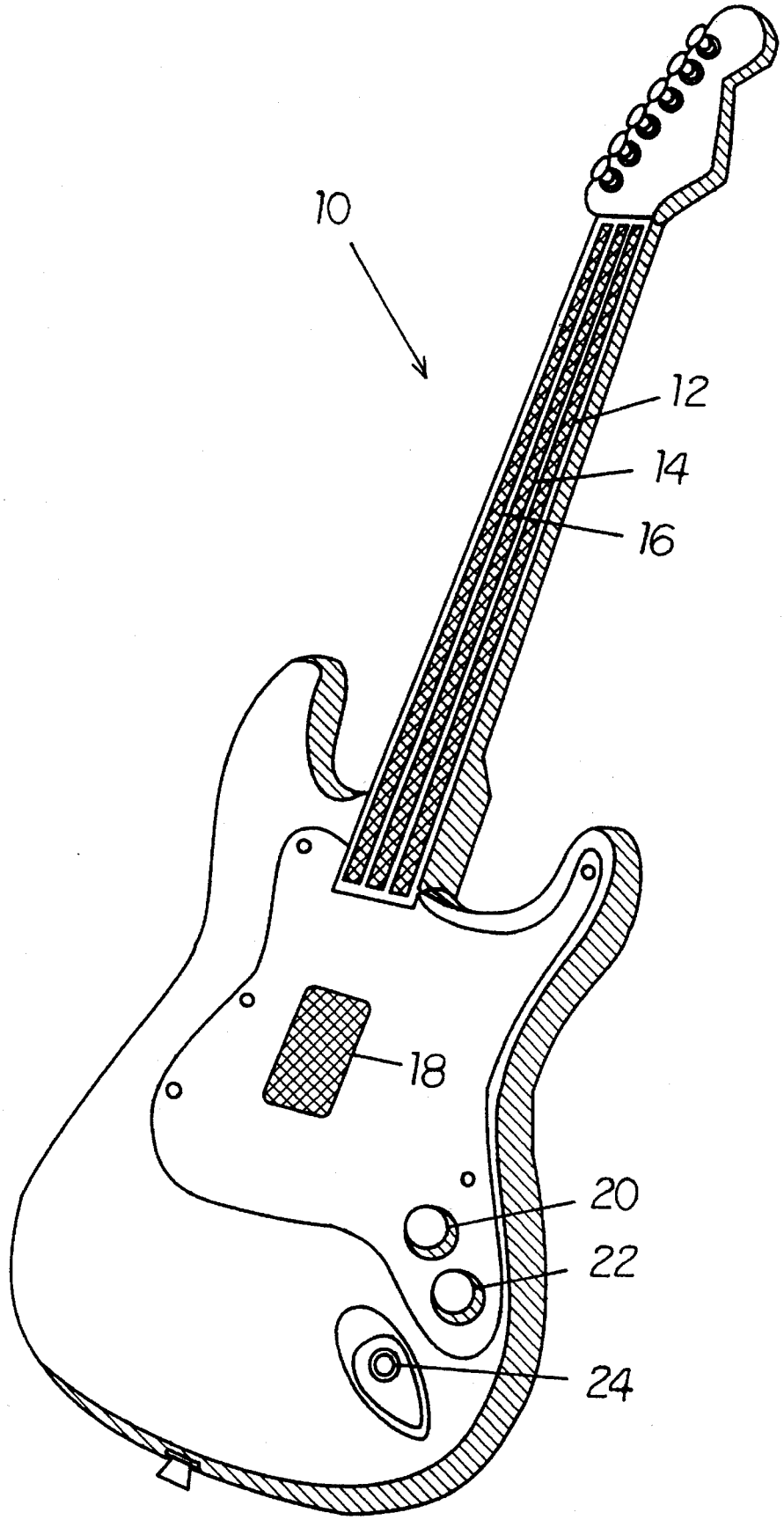
FIG. 1 is a perspective view of the preferred embodiment of the present invention.

A musical instrument simulation device 10 according to the present invention is depicted in FIG. 1. As shown in FIG. 1, the device is in the shape of a double cut-away electric guitar. The shape of the device, however, is not critical. The musical instrument simulation device can be designed and shaped to simulate any type of musical instrument, including all string and keyboard instruments without exception, drums, single and double reed woodwinds, horns and other brass, etc. For brevity and clarity, hereinafter the invention will be described only in reference to the simulated guitar shown in FIG. 1. This should not be seen as Limiting the invention in any fashion.

The simulated guitar 10 includes electrical connector 24 for inserting the simulated guitar 10 into the signal path of an audio signal generated by an audio source generator (not shown) at a point subsequent to the generation of the audio signal, but prior to the demodulation of the audio signal into audible sounds by a speaker assembly (not shown). For example, audio source generators include, but are not limited to, such devices as analog and digital tape players, radio receivers of all types (AM, FM, short band, etc.), compact disc (CD) and mini-CD players, video disc players of all formats, VCR tape players of all formats, vinyl record players, computer-stored digitized audio signals, and the like. The electrical connector 24 allows the simulated guitar 10 to be inserted into the signal path of these devices prior to the demodulation of the audio signal. The connector 24 can be any suitable type of electrical connector known in the art, for instance, any number of coaxial-type electrical connectors.

The simulated guitar 10 includes a plurality of pressure-sensitive simulated musical instrument triggers 12, 14, 16, and 18. As shown in FIG. 1, the musical instrument triggers are divided into a plurality of elongated band pass keys 12, 14, and 16; and a roughly square strum pad trigger 18. This particular arrangement of band pass keys and a strum pad is selected to accurately simulate the design of an actual guitar. Designs to simulate other musical instruments are easily envisioned. For instance, to simulate a keyboard instrument, the band pass keys would be designed and arranged to appear as the black and white keys of a standard piano. The strum pad trigger would then be designed and arranged to appear as a foot pedal on the simulated piano.

The band pass keys 12, 14, and 16 are pressure-sensitive controls which select a particular pass band signal which is to be amplified. For the simulated guitar shown in FIG. 1, the audio signal from the audio source is split into three band pass signals: a treble band pass signal, a midrange band pass signal, and a bass band pass signal. By exerting pressure on band pass keys 12, 14, and/or 16, a user selects either the treble, midrange, or bass band pass signals to be amplified, respectively. In this manner, the treble, midrange, and/or bass band pass signals are selected for amplification.

Again, variations on this design are easily envisioned: The audio signal may be divided into a relatively large plurality of band pass signals, and a corresponding number of band pass keys employed. For instance, in the simulated electric guitar instead of having three band pass keys, a different band pass key could be placed on the neck of the simulated guitar at positions corresponding to the individual fret positions of an actual electric guitar. Here, this would result in 132 band pass keys. (A standard electric guitar has 22 frets, multiplied by six strings, equals 132 fret positions.) The audio signal would then be split into a corresponding number of band pass signals, with each band pass signal having a corresponding band pass key. To simulate a standard piano, 88 band pass keys in the form of piano keys would be used, and the audio signal would be split into 88 corresponding band pass signals.

To amplify the selected band pass signals, a user exerts pressure on the strum pad trigger 18. The band pass signals which are selected for amplification by pressure exerted on the band pass keys (12, 14, and 16) are then amplified for a variable and user-adjustable length of time. The amount of amplification applied to the selected band pass signals may also be modified by a user-adjustable master volume control knob 22. The duration of the amplification may be modified using time duration adjustment knob 20. of course, knobs 20, and 22, are positioned and designed to simulate the tone and/or volume knobs of an actual guitar, and strum pad trigger 18 is positioned on the body of the guitar housing. In operation, the simulated guitar 10 can be "played" using the same motions, and in much the same fashion as an actual guitar.

After the predetermined length of time has expired since the last depression of the strum pad trigger 18, the amplification of all of the band pass signals returns to a baseline amplification level. Each band pass signal, whether amplified by a predetermined set value or the user set value, is then recombined via audio signal combining circuitry to form a combined audio output signal. This audio output signal is then delivered, in due course, to an audio amplifier and speaker assembly where the recombined audio signal is demodulated into audible sounds.

Figure 2:
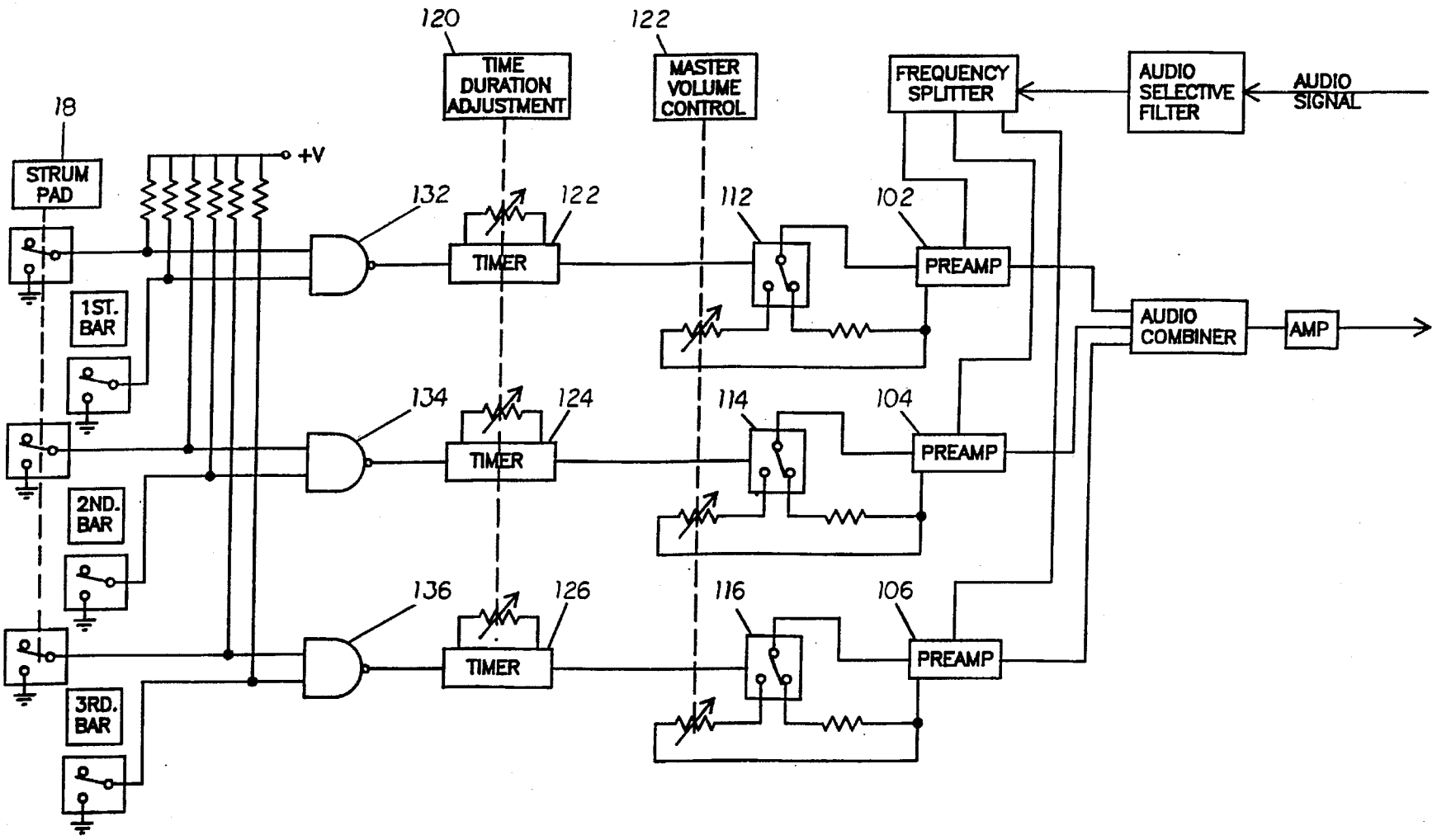
FIG. 2 is an electrical schematic diagram of the preferred embodiment of the present invention.

FIG. 2 illustrates an electrical circuit which will perform the various functions of the simulated guitar 10 as described above. The raw audio signal from an audio source (not shown) is input into an audio-selective filter shown at the upper right corner of FIG. 2. The audio-selective filter functions to pre-filter and reduce any unwanted noise or other signals contained within the raw audio signal, and thereby generate a filtered audio signal. The audio-selective filter may have a predetermined or a variable audio bandwidth, and may include means for separating and/or isolating vocal signals from the other signals contained within the raw audio signal. Means for separating vocal signals would include such devices as fixed or variable audio bandwidth band pass filters, dynamic microprocessor-controlled audio band pass circuitry, and the like.

The invention may also include circuitry to separate and/or isolate individual voice and instrument signals from within a musical audio source signal. The isolation or separation of any given voice signal from the audio source signal may be accomplished by the audio-selective filter, as described above. Additionally, or alternatively, the present invention may include circuitry to isolate a given musical voice. For instance, a guitar-shaped instrument may contain circuitry capable of isolating the guitar voice from a musical work. As noted above, means for separating and/or isolating individual voice signals include such devices as fixed or variable audio bandwidth band pass filters, dynamic microprocessor-controlled audio band pass circuitry, and the like.

The filtered audio signal generated by the audio-selective filter is then fed to at least one frequency splitter connected to said audio pre-filter. The frequency splitter separates the filtered audio signal into a plurality of band pass signals. Each of the plurality of band pass signals generated by the frequency splitter contains a specific and unique frequency portion of the entire bandwidth of the filtered audio signal. In FIG. 2, the frequency splitter is shown splitting the filtered audio signal into three unique band pass signals. These three band pass signals correspond to the treble, midrange, and bass portions of the filtered audio signal.

Each of the plurality of band pass signals generated by the frequency splitter is then input into a corresponding plurality of preamps, 102, 104, and 106. Each of the plurality of preamps has an input for receiving one of the plurality of band pass signals, and an output for transmitting the amplified band pass signal.

A corresponding plurality of gain control circuits 112, 114, and 116, is connected to the preamps, one gain control circuit per preamp, to control the gain to be applied to the band pass signals as the signals pass through each preamp.

Each of the gain control circuits has two states of operation: In the first state of operation, each gain control circuit applies a baseline gain to each preamp. This baseline gain can either be fixed and predetermined, or variable. In FIG. 2, each of the gain control circuits 112, 114, and 116, is shown in the first state of operation, and the baseline gain is fixed.

In the second state of operation, each of the gain control circuits is capable of modifying the gain of the preamp to which it is connected to a user-adjustable level. In FIG. 2, this user-adjustable level is shown as a variable resistor to the lower left of each of the gain control circuits 112, 114, and 116. The overall gain of the entire plurality of preamps is controlled by a master volume control 122. The master volume control 122, is set by a user via master volume control knob 22 shown in FIG. 1.

A corresponding plurality of timers 122, 124, and 126, is connected to the plurality gain control circuits 112, 114, and 116, one timer per gain control circuit. When activated, each timer produces and supplies an electric pulse of a given duration to the gain control circuit to which it is attached. The electric pulse sent from each timer to its respective gain control circuit shifts the operation of the gain control circuit from the first state of operation to the second. When the electric pulse is terminated, the gain control circuit reverts back to the first state of operation.

Timer control circuitry, depicted in FIG. 2 as a corresponding number of two-input AND logic gates 132, 134, and 136, are attached to timers 122, 124, and 126. Preferably, logic gates 132, 134, and 136 are electronic circuits, but conventional electric circuits may also be used. The logic gates detect, and are responsive to, whether or not a given simulated musical instrument trigger has been activated.

In the simulated guitar depicted in FIG. 1, the simulated musical instrument triggers are the three band pass keys 12, 14, 16; and the strum pad trigger 18. Circuit means responsive to pressure exerted on one each of the three band pass keys 12, 14, 16 is shown directly below the boxes labelled "1ST. BAR," "2ND. BAR," and "3RD. BAR," respectively, in FIG. 2. A corresponding number of circuit means, all of which are responsive to the strum pad trigger are located on the far left of FIG. 2, under the box labelled "STRUM PAD."

Each AND gate is responsive to the condition of both the strum pad the band pass key to which it is attached. Taking the band pass key 12 as an example, band pass key 12 is represented in FIG. 2 as the switch directly below the box labelled "1ST. BAR." When band pass key 12 is activated, as is shown in FIG. 2, the circuit branch leading to its respective AND gate will be charged. Now, when the strum pad is activated, as is also shown in FIG. 2, both of the circuit branches leading to the AND gate will be charged, and the AND gate will send a signal to the timer, which will then send a signal to the gain control circuit. The gain control circuit will then adjust the preamp to amplify or attenuate the chosen band pass signal to a given, user-selected level.

If the strum pad is activated without any of the band pass keys being activated, the frequency-split signals will be amplified or attenuated according to the baseline gain to which the preamps are set. As noted above, in FIG. 2, the baseline gain is shown as predetermined and fixed, although the baseline gain may be user-variable if desired.

The frequency-divided signals are then recombined into a single combined signal via an audio combiner circuit. The audio combiner circuit can be any type of conventional electrical or electronic circuitry employed to recombine a plurality of signals having different frequencies. The recombined signal is then output to an amplifier/speaker assembly where the signal is demodulated into audible sounds.

It is to be understood that the present invention is not limited to the sole embodiment described above, but encompasses any and all embodiments within the scope of the following claims.

I claim:

1. A musical instrument simulation device comprising:

an audio-selective filter connected to an audio source for filtering an audio signal generated by the audio source to produce a filtered audio signal;

at least one frequency splitter connected to said audio-selective filter for separating said filtered audio signal into a plurality of band pass signals, each of said plurality band pass signals containing a portion of said filtered audio signal within a predetermined unique bandwidth thereof;

a plurality of preamps, each of said plurality of preamps having an input for receiving one of said plurality of band pass signals so as to amplify said one band pass signal supplied thereto to produce an amplified band pass signal, and an output for transmitting said amplified band pass signal;

a plurality of gain control circuits, each of said plurality of preamps having one of said plurality of gain control circuits attached thereto, each of said plurality of gain control circuits having a first state of operation and a second state of operation, in said first state of operation each of said plurality of gain control circuits capable of maintaining an amplification factor of said preamp to which it is connected at a predetermined value, and in said second state of operation each of said plurality of gain control circuits capable of modifying said amplification factor to a user-adjustable value;

a plurality of timers, each of said gain control circuits having one of said plurality of timers connected thereto, each of said plurality of timers capable of producing and supplying an electric pulse of a given duration upon the activation thereof to said gain control circuit to which said timer is attached, each of said gain control circuits operating in said second state of operation while said pulse is supplied thereto and operating in said first state of operation in the absence of said pulse;

timer control circuitry connected to each of said plurality of timers;

a plurality of simulated musical instrument triggers connected to said timer control circuitry for selectively activating one or more of said plurality of timers in response to activation of selective ones of said simulated musical instrument triggers; and audio signal combining circuitry for combining each of said amplified band pass signals transmitted by each of said plurality of preamps into a combined audio signal.

2. The musical instrument simulation device according to claim 1, further comprising an audio amplifier connected to said audio signal combining circuitry.

3. The musical instrument simulation device according to claim 2, further comprising a user-adjustable master volume control capable of modifying said user-adjustable value of said amplification factors of all of said plurality of preamps.

4. The musical instrument simulation device according to claim 3, further comprising a user-adjustable time duration control capable of modifying said predetermined duration of each of said electric pulses produced by each of said plurality of timers.

5. The musical instrument simulation device according to claim 4, wherein said simulated musical instrument triggers include a plurality of band pass keys and a strum pad trigger and wherein said timer control circuitry further includes means for activating specific ones of said plurality of timers independently in response to activation of said strum pad trigger and specific ones of said plurality of band pass keys.

6. The musical instrument simulation device according to claim 5, further comprising a housing in the shape of a musical instrument.

7. The musical instrument simulation device according to claim 6, wherein said housing is a guitar-shaped housing including a neck portion and a body portion; and wherein each of said plurality of band pass keys is an elongated, touch sensitive member located on said neck portion of said guitar-shaped housing, and said a strum pad trigger is located in a center portion of said body portion of said guitar-shaped housing.

8. A musical instrument simulation device comprising:

an audio-selective filter connected to an audio source for filtering an audio signal generated by the audio source to produce a filtered audio signal, and wherein said audio-selective filter includes means for separating vocal signals from all other signals from within said audio signal;

at least one frequency splitter connected to said audio-selective filter for separating said filtered audio signal into a plurality of band pass signals, each of said plurality band pass signals containing a portion of said filtered audio signal within a predetermined unique bandwidth thereof;

a plurality of preamps, each of said plurality of preamps having an input for receiving one of said plurality of band pass signals so as to amplify said one band pass signal supplied thereto to produce an amplified band pass signal, and an output for transmitting said amplified band pass signal;

a plurality of gain control circuits, each of said plurality preamps having one of said plurality of gain control circuits attached thereto, each of said plurality of gain control circuits having a first state of operation and a second state of operation, in said first state of operation each of said plurality of gain control circuits capable of maintaining an amplification factor of said preamp to which it is connected at a predetermined value, and in said second state of operation each of said plurality of gain control circuits capable of modifying said amplification factor to a user-adjustable value;

a plurality of timers, each of said gain control circuits having one of said plurality of timers connected thereto, each of said plurality of timers capable of producing and supplying an electric pulse of a given duration upon the activation thereof to said gain control circuit to which said timer is attached, each of said gain control circuits operating in said second state of operation while said pulse is supplied thereto and operating in said first state of operation in the absence of said pulse;

timer control circuitry connected to each of said plurality of timers;

a plurality of simulated musical instrument triggers connected to said timer control circuitry for selectively activating one or more of said plurality of timers in response to activation of selective ones of said simulated musical instrument triggers; and audio signal combining circuitry for combining each of said amplified band pass signals transmitted by each of said plurality of preamps into a combined audio signal.

9. The musical instrument simulation device according to claim 8, further comprising an audio amplifier connected to said audio signal combining circuitry.

10. The musical instrument simulation device according to claim 9, further comprising a user-adjustable master volume control capable of modifying said user-adjustable value of said amplification factors of all of said plurality of preamps.

11. The musical instrument simulation device according to claim 10, further comprising a user-adjustable time duration control capable of modifying said predetermined duration of each of said electric pulses produced by each of said plurality of timers.

12. The musical instrument simulation device according to claim 11, wherein said simulated musical instrument triggers include a plurality of band pass keys and a strum pad trigger and wherein said timer control circuitry further includes means for activating specific ones of said plurality of timers independently in response to activation of said strum pad trigger and specific ones of said plurality of band pass keys.

13. The musical instrument simulation device according to claim 12, further comprising a housing in the shape of a musical instrument.

14. The musical instrument simulation device according to claim 13, wherein said housing is a guitar-shaped housing including a neck portion and a body portion; and wherein each of said plurality of band pass keys is an elongated, touch sensitive member located on said neck portion of said guitar-shaped housing, and said a strum pad trigger is located in a center portion of said body portion of said guitar-shaped housing.

* * * * *